US005319331A

United States Patent [19]

Hirawata et al.

[11] Patent Number: 5,319,331

[45] Date of Patent: Jun. 7, 1994

[54] ELECTROMAGNETIC RELAY

[75] Inventors: Seiichi Hirawata, Ryugasaki; Hiroshi Hirata, Yamato, both of Japan

[73] Assignee: Niles Parts Co., Ltd., Tokyo, Japan

[21] Appl. No.: 101,980

[22] Filed: Aug. 4, 1993

[30] Foreign Application Priority Data

Apr. 14, 1993 [JP] Japan ..... 5-24684

[51] Int. Cl.[5] ..... H01H 51/22

[52] U.S. Cl. ..... 335/78; 335/80

[58] Field of Search ..... 335/78-86, 335/124, 128, 131

[56] References Cited

U.S. PATENT DOCUMENTS 4,691,181 9/1987 Katsutani et al. ..... 335/128

5,083,104 1/1992 Bassino ..... 335/128

FOREIGN PATENT DOCUMENTS 56-170852 12/1981 Japan .

*Primary Examiner*—Lincoln Donovan

*Attorney, Agent, or Firm*—Ronald P. Kananen

[57] ABSTRACT

An electromagnetic relay having a plate spring provided with a fixed contact, a movable contact and an L-shaped bent portion at the middle portion of the plate spring, and an armature fixed on one side of the plate spring with respect to the bent portion. The armature includes a first offset portion spaced apart from the plate spring between a first fixed portion of the plate spring and the bent portion and a blocking portion for changing the supporting arrangement of the plate spring in accordance with the deflection of the plate spring. A yoke is fixed on the other side of the plate spring with respect to the bent portion and has a second offset portion spaced apart from the plate spring between a second fixed portion of the plate spring and the bent portion. As a result, the magnetic path of the armature and the yoke is not made narrow in the case where a working precision is increased by reducing the number of the portions at which the plate spring is bent, and a sufficient contact pressure can be maintained without generating a two-step operation phenomenon even when the suction force of the coil is low.

2 Claims, 4 Drawing Sheets

ELECTROMAGNETIC RELAY

BACKGROUND OF THE INVENTION

1. Field of the Invention

The present invention relates generally to switching devices, and in particular to an improved electromagnetic relay.

2. Description of the Prior Art

In the prior art, there is known an electromagnetic relay of the hinge-type, as disclosed in Japanese Utility Model Laid-Open Publication No. 56-170852, in which the switching operation of the relay is achieved by the swinging operation of an armature generated on the basis of excitation or deexcitation of the electromagnet. In this device, the contact surface of a movable contact plate of a yoke and/or armature in the contact portion at which the armature contacts with the yoke is beveled.

According to the conventional electromagnetic relay, since the contact surface of a movable contact plate of the yoke and/or armature in the contact portion at which the armature contacts with the yoke is beveled, the magnetic path is made narrow at the beveled portion thereby undesirably reducing the efficiency of the magnetic circuit. In accordance with the efficiency reduction, the suction force due to the coil is also reduced thereby generating an insufficient suction force for the armature. The reduced suction force results in problems such that the minimum operation voltage of the electromagnet is increased, and the so-called two-step operation phenomenon of the relay is generated, whereby a sufficient contacting pressure is not maintained.

SUMMARY OF THE INVENTION

The present invention is made to solve the above-mentioned problems, wherein the first object of the present invention is to provide an electromagnetic relay in which the magnetic path of an armature and a yoke is not made narrow in the case where a working precision is increased by reducing the number of the portions at which the plate spring is bent.

The second object of the present invention is to maintain a sufficient contacting pressure without the so-called two-step contact phenomenon even when the suction force of the coil is low.

Additional objects, advantages and novel features of the invention will be set forth in the description which follows, and will become apparent to those skilled in the art upon reading this description or practicing the invention. The objects and advantages of the invention may be realized and attained by the appended claims.

In order to achieve the first object of the present invention, there is provided an electromagnetic relay having a plate spring provided with a fixed contact and an L-shaped bent portion at the middle portion of the plate spring, an armature fixed on one side of the plate spring with respect to the bent portion, and a yoke fixed on the other side of the plate spring with respect to the bent portion; wherein the armature provides a first offset portion apart from the plate spring between the portion at which the armature is fixed to the plate spring and the bent portion, and the yoke provides a second offset portion apart from the plate spring between the portion at which the yoke is fixed to the plate spring and the bent portion.

In order to achieve the second object of the present invention, there is provided an electromagnetic relay having a plate spring provided with a fixed contact and an L-shaped bent portion at the middle portion of the plate spring, an armature fixed on one side of the plate spring with respect to the bent portion, and a yoke fixed on the other side of the plate spring with respect to the bent portion; wherein the armature has a blocking portion for changing the position of the supporting point of the plate spring in accordance with the degree of deflection of the plate spring.

BRIEF DESCRIPTION OF THE DRAWINGS

The accompanying drawings, which are incorporated in, and form a part of, the specification, illustrate an embodiment of the present invention and, together with the description, serve to explain the principles of the invention. In the drawings:

FIGS. 3(A), 3(B), 3(C) and 3(D) are views for explaining the operation of the embodiment, in which FIG. 3(A) shows the state at which the movable contact is in contact with the normally closed contact, FIG. 3(B) shows the state at which the movable contact is in contact with the normally open contact, FIG. 3(C) shows the state at which the plate spring engages with the blocking portion, and FIG. 3(D) shows the state at which the magnet gap is decreased to zero by the armature being completely sucked into engagement with the core.

DESCRIPTION OF THE PREFERRED EMBODIMENTS

Reference will now be made in detail to the preferred embodiment of the invention, an example of which is illustrated in the accompanying drawings.

Figure 1:
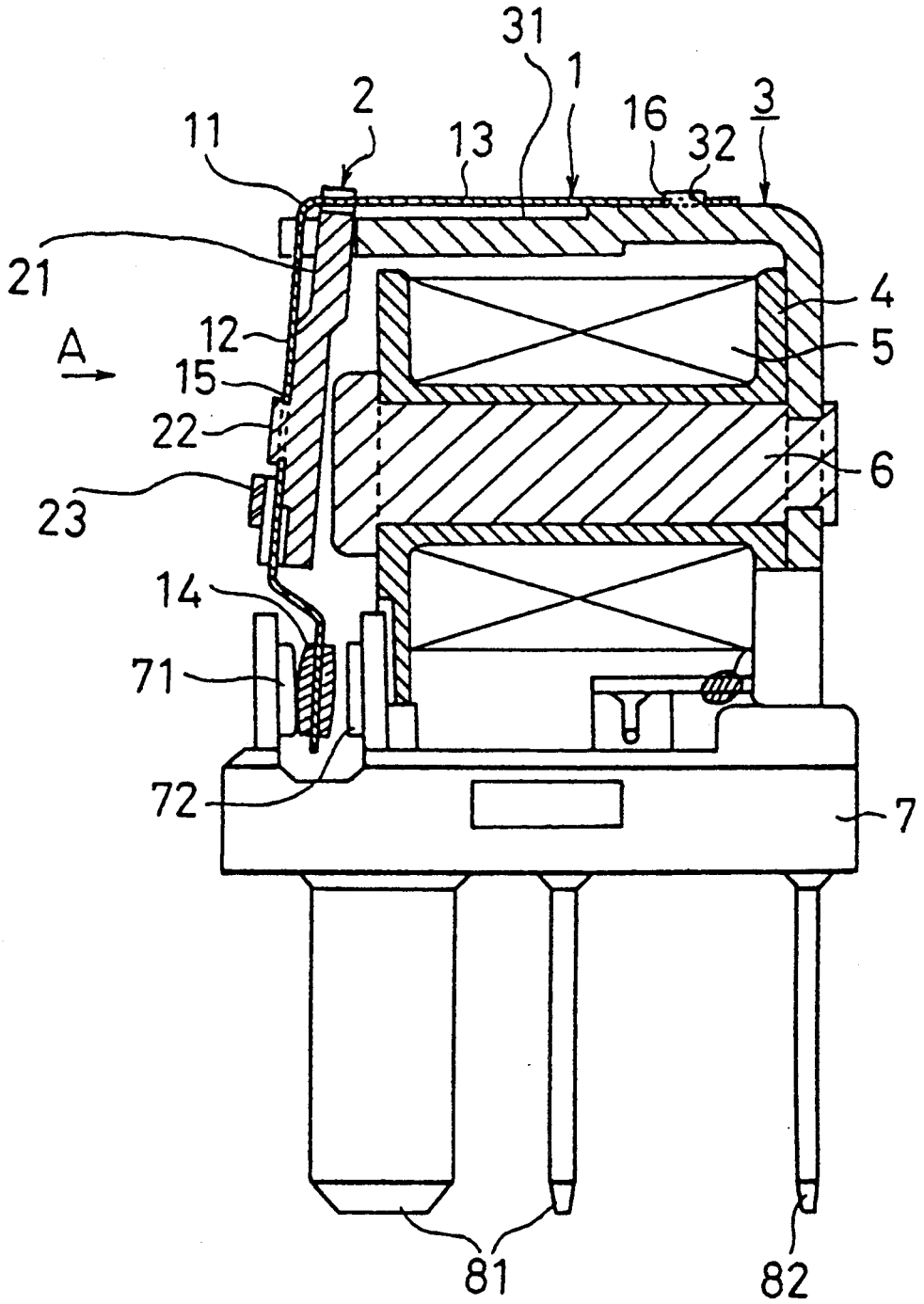
FIG. 1 is a sectional side view showing the main parts of an electromagnetic relay of a preferred embodiment of the present invention.
Figure 2:
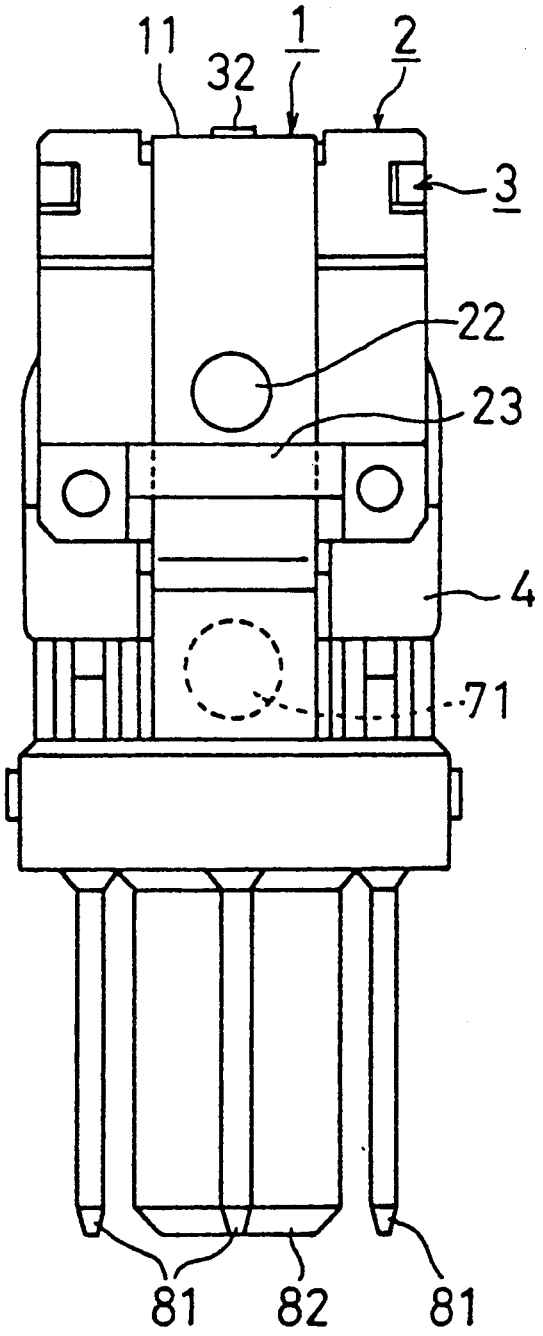
FIG. 2 is a side view of the embodiment as seen in the direction indicated by arrow A in FIG. 1.

In the drawings, FIGS. 1 and 2 show an electromagnetic relay having a plate spring 1, an armature 2, a yoke 3, a bobbin 4, a coil 5, a core 6, a base 7 and terminals 81 and 82.

The plate spring 1 is composed of an elastic plate material made of phosphor bronze or the like, formed by using a press molding method. The plate spring 1 has an L-shaped bent portion 11 at a middle portion thereof, and is fixed with the armature 2 and a movable contact 14 at one side 12 of the plate spring 1 with respect to the bent portion 11, and is fixed on the yoke 3 at the other side 13 of the plate spring 1 with respect to the bent portion 11.

The armature 2 is composed of a plate made of ferromagnetic material such as soft iron. The armature 2 has a first offset portion 21 spaced from the plate spring 1 between a first fixed portion 15, at which the armature 2 is fixed on the plate spring 1, and the bent portion 11. The armature 2 includes a boss 22 for fixing the plate spring 1 at the central fixed portion 15.

The armature 2 also has a blocking portion 23 for changing the supporting point of the plate spring 1 in accordance with the degree of deflection of the plate spring 1. The blocking portion 23 is caulked on the armature 2 at the portion near to the boss 22 of the armature 2. A predetermined gap is provided between the blocking portion 23 and the plate spring 1.

The yoke 3 is composed of a plate made of ferromagnetic material, such as soft iron, similar to the armature 2, and is formed by using a press molding method. The yoke 3 has a second offset portion 31 spaced from the plate spring 1 between a second fixed portion 16, at which the yoke 3 is fixed on the plate spring 1, and the bent portion 11. The yoke 3 includes a boss 32 for fixing the second fixed portion 16 of the plate spring 1 at the near portion of the second offset portion 31.

The bobbin 4 is wound with the coil 5 and is mounted on the core 6 which is mounted to the yoke 3. The core 6 is made of ferromagnetic material.

The base 7 is made of a synthetic resin material and is formed by using a press molding method. Furthermore, the base 7 has a normally closed contact 71, a normally open contact 72, a terminal 81 inserted therein by using an insertion molding method, and a terminal 82 integrally formed with the yoke 3. The operation of the embodiment thus constructed will be explained with reference to FIGS. 3 and 4.

Figure 4:
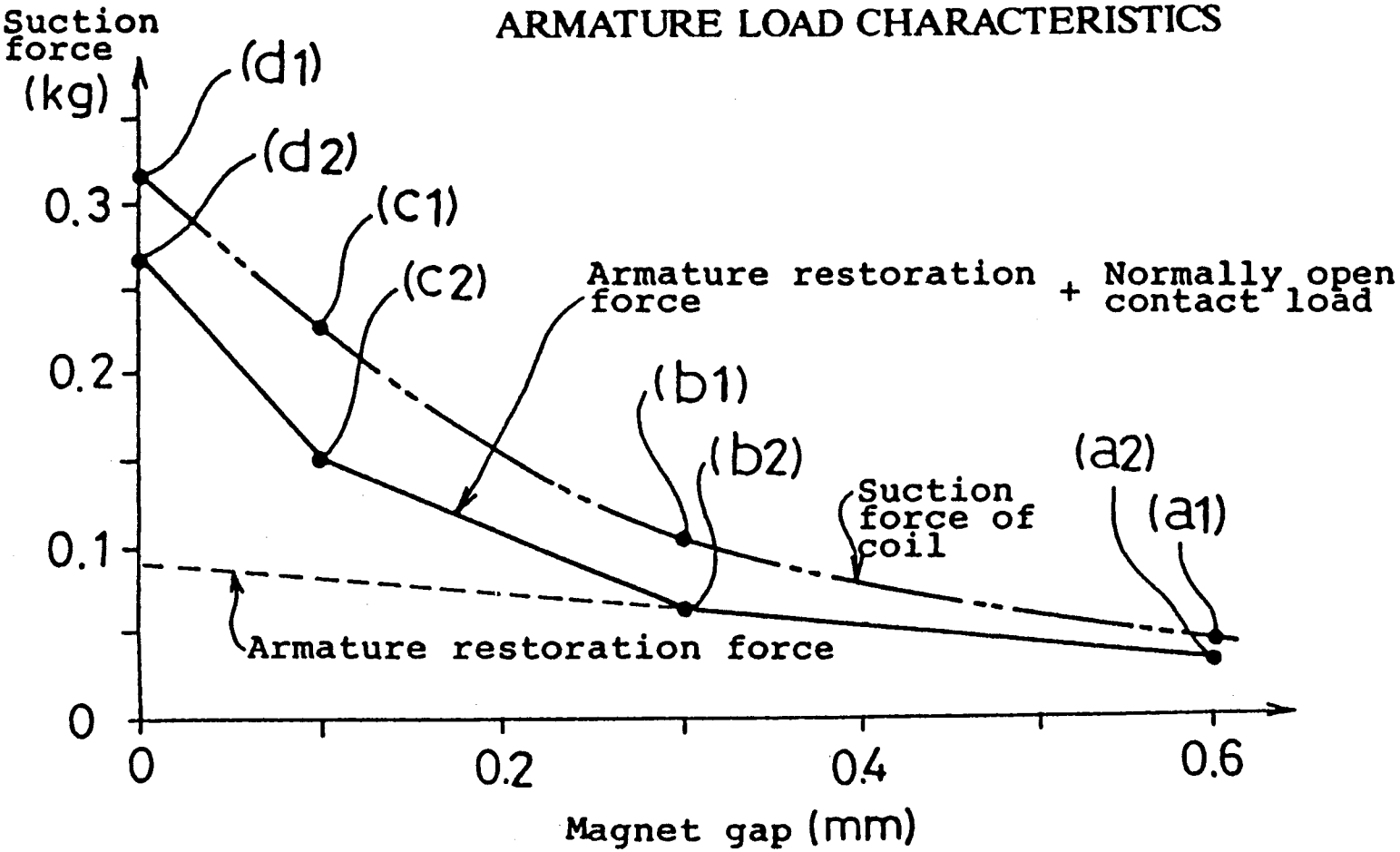
FIG. 4 is a graph showing the armature load characteristics of the electromagnetic relay shown in FIG. 1.

As the excitation current supplied to the coil 5 is increased, the suction force due to the coil 5 is also increased, as shown by the two-dotted line (a1) to (d1) in FIG. 4, and the force affected to the armature 2, i.e. the sum of an armature restoration force and a normally open contact load, is changed as shown by the solid line (a2) to (d2) in FIG. 4.

Figure 3A:
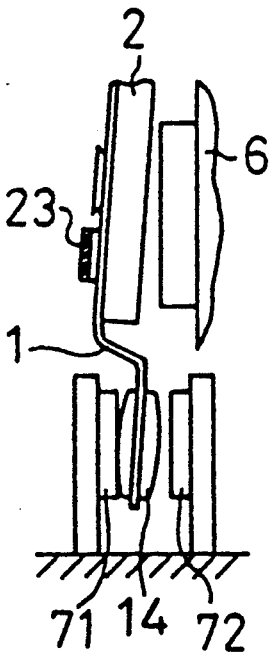

For example, when the coil suction force has the magnitude as shown by (a1) in FIG. 4, the magnitude of the restoration force affected to the armature 2 is shown by (a2) in FIG. 4. At this time, the armature 2, the plate spring 1, and the movable contact 14 are positioned at the position as shown in FIG. 3(A) where the movable contact 14 contacts with the normally closed contact 71.

Figure 3B:
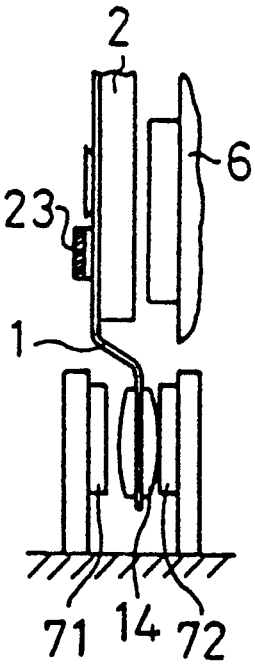

Then, when the magnitude of the coil suction force is changed from (a1) to (b1) in FIG. 4, the magnitude of the restoration force applied to the armature 2 increases from (a2) to (b2) in FIG. 4 as the magnet gap is decreased. When the magnitude of the restoration force applied to the armature 2 reaches (b2) in FIG. 4, the armature 2, the plate spring 1, and the movable contact 14 are displaced to the position as shown by FIG. 3(B), where the movable contact 14 is removed from the normally closed contact 71 and contacts with the normally open contact 72.

Then, when the magnitude of the coil suction force is changed from (b1) to (c1) in FIG. 4, the magnitude of the restoration force applied to the armature 2 increases from (b2) to (c2) in FIG. 4 as the magnet gap is further decreased, because a contact load due to the normally open contact 72 is superimposed to the restoration force of the armature 2.

Figure 3C:
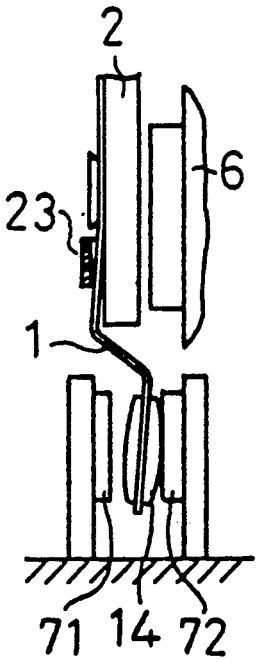

Then, when the force applied to the armature 2 reaches the magnitude as shown by (c2) in FIG. 4, the armature 2, the plate spring 1, and the movable contact 14 are displaced to the position as shown in FIG. 3(C). At this time, the plate spring 1 just touches the blocking portion 23 causing the supporting point of the plate spring 1 to be changed from the position of the boss 22 to the engaging position of the blocking portion 23, thereby increasing the contact load of the normally open contact 72.

Figure 3D:
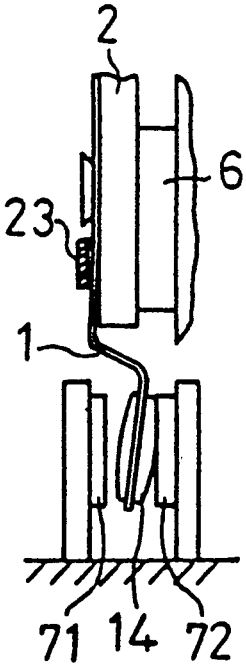

Then, when the magnitude of the coil suction force is changed from (c1) to (d1) in FIG. 4, the force applied to the armature 2 increases from (c2) to (d2) in FIG. 4 as the magnet gap is decreased, because the contact load of the normally open contact 72 increased by the engagement of the plate spring 1 with the blocking portion 23, is superimposed onto the restoration force of the armature 2. When the force applied to the armature 2 reaches the magnitude as shown by (d2) in FIG. 4, the armature 2, the plate spring 1, and the movable contact 14 are displaced to the position as shown in FIG. 3(D).

As mentioned above, the load characteristics of the armature 2 can be made to more closely follow the coil suction force characteristics, because the load characteristics of the armature 2 are altered by the bending operation generated at the blocking portion 23.

As a result, the so-called two-step operation phenomenon of the relay may be avoided even when the coil suction force is comparatively small, the contact load of the normally open contact 72 with respect to the movable contact 14 may be sufficiently maintained, and a low contact resistance is achieved to ensure a long life of the contact with a high reliability.

According to the present invention the following advantages are obtained.

The first aspect of the present invention is featured by the construction of an electromagnetic relay to include a plate spring provided with a fixed contact and an L-shaped bent portion at the middle portion of the plate spring, an armature fixed on one side of the plate spring with respect to the bent portion, and a yoke fixed on the other side of the plate spring with respect to the bent portion; wherein the armature provides a first offset portion spaced from the plate spring between the portion at which the armature is fixed to the plate spring and the bent portion, and the yoke provides a second offset portion spaced from the plate spring between the portion at which the yoke is fixed to the plate spring and the bent portion. Therefore, the magnetic path of the armature and the yoke is not made narrow, and the working precision of the relay is increased by reducing the number of the portions at which the plate spring is bent.

The second aspect of the present invention is featured by the construction of the armature with a blocking portion for changing the position of the supporting point of the plate spring in accordance with the degree of deflection of the plate spring. Therefore, a sufficient contact pressure is maintained without generating the two-step operation phenomenon even when the suction force of the coil is low, and further, it is easily achieved merely by providing the blocking portion on the armature.

The illustrated embodiment was chosen and described in order to best explain the principles of the invention and its practical application to thereby enable others skilled in the art to best utilize the invention and various modifications as are suited to the particular use contemplated. It is intended that the scope of the invention only be limited by the claims appended hereto.

What is claimed is:

1. An electromagnetic relay comprising:

a plate spring provided with a movable contact and an L-shaped bent portion at a middle portion of said plate spring;

an armature fixed to said plate spring on one side of said bent portion; and a yoke fixed to said plate spring on the other side of said bent portion;

wherein said armature provides a first offset portion spaced from said plate between the portion at which said armature is fixed to said plate spring and said bent portion, and said yoke provides a second offset portion spaced from said plate spring between the portion at which said yoke is fixed to said plate spring and said bent portion, wherein said armature further comprises a blocking portion for changing a supporting arrangement of said plate spring in accordance with the degree of deflection of said plate spring, wherein said blocking portion is positioned on said armature between the point where said armature is fixed to said plate spring and an end of said plate spring supporting said movable contact and engages said plate spring when said plate spring is deflected a predetermined amount, whereby the engagement of said blocking portion with said plate spring creates a higher contact force between said movable contact and a normally open contact upon deflection of said plate spring beyond said predetermined amount.

2. An electromagnetic relay comprising:

a plate spring provided with a movable contact and an L-shaped bent portion at a middle portion of said plate spring;

an armature fixed to said plate spring on one side of said bent portion; and a yoke fixed to said plate spring on the other side of said bent portion;

wherein said armature has a blocking portion for changing a supporting arrangement of said plate spring in accordance with the degree of deflection of said plate spring, wherein said blocking portion is positioned on said armature between the point where said armature is fixed to said plate spring and an end of said plate spring supporting said movable contact and engages said plate spring when said plate spring is deflected a predetermined amount, whereby the engagement of said blocking portion with said plate spring creates a high contact force between said movable contact and a normally open contact upon deflection of said plate spring beyond said predetermined amount.

* * * * *